US007469773B2

(12) United States Patent
Yoon

(10) Patent No.: US 7,469,773 B2
(45) Date of Patent: Dec. 30, 2008

(54) ASSISTANT CEILING DEVICE FOR SHIELDING ESCAPE HATCH OF AN ELEVATOR

(76) Inventor: Ii Shik Yoon, 476-35 Gurobondong, Gurogu, Seoul (KR) 152-059

( * ) Notice: Subject to any disclaimer, the term of this patent is extended or adjusted under 35 U.S.C. 154(b) by 0 days.

(21) Appl. No.: 10/581,959

(22) PCT Filed: Dec. 8, 2004

(86) PCT No.: PCT/KR2004/003218

§ 371 (c)(1),
(2), (4) Date: Apr. 2, 2007

(87) PCT Pub. No.: WO2005/056458

PCT Pub. Date: Jun. 23, 2005

(65) Prior Publication Data

US 2007/0251767 A1 Nov. 1, 2007

(30) Foreign Application Priority Data

Dec. 10, 2003 (KR) ..... 20-2003-0038442 U

(51) Int. Cl.
*B66B 11/02* (2006.01)

(52) U.S. Cl. ..... 187/401; 187/313; 187/314; 187/414; 52/506.06; 248/237; 248/221.11; 248/323; 49/68; 49/143; 49/214

(58) Field of Classification Search ..... 187/314, 187/393, 401, 414, 313; 52/220.8, 717.01, 52/718.01, 506.01–506.09; 248/544, 237, 248/221.11, 301, 323, 343; 454/68, 292, 454/370, 83, 84, 87, 136; 49/62, 68, 143, 49/214, 413, 453; *B66B 13/02, 11/02, 7/00*
See application file for complete search history.

(56) References Cited

U.S. PATENT DOCUMENTS

| | | | | |
|---|---|---|---|---|
| 3,175,656 | A * | 3/1965 | Schoenfeld | 52/733.1 |
| 5,337,525 | A * | 8/1994 | Zaccai et al. | 52/35 |
| 5,412,912 | A * | 5/1995 | Alves | 52/36.5 |
| 2003/0213199 | A1 * | 11/2003 | Bongio et al. | 52/506.01 |

FOREIGN PATENT DOCUMENTS

| | | | |
|---|---|---|---|
| JP | 02013590 | A * | 1/1990 |
| JP | 03293276 | A * | 12/1991 |
| JP | 05230928 | A * | 9/1993 |

* cited by examiner

*Primary Examiner*—Peter M Cuomo
*Assistant Examiner*—Stefan Kruer
(74) *Attorney, Agent, or Firm*—Lumen Paten Firm

(57) ABSTRACT

An assistant ceiling device designed to shield an escape hatch installed to a ceiling of an elevator cab is provided. The assistant ceiling device includes two elongated rail guides and a rectangular assistant ceiling plate. Each guide is installed at either side of the emergency escape hatch and has a length longer than that of the emergency escape hatch and shorter than that of the ceiling of the elevator cab. The assistant ceiling plate is laid on the rail guides to shield the emergency escape hatch. Each guide has a latching jaw so as to allow the assistant ceiling plate to be installed to the rail guides by laying both sides of the ceiling plate on the latching jaws.

3 Claims, 5 Drawing Sheets

[Fig. 1]
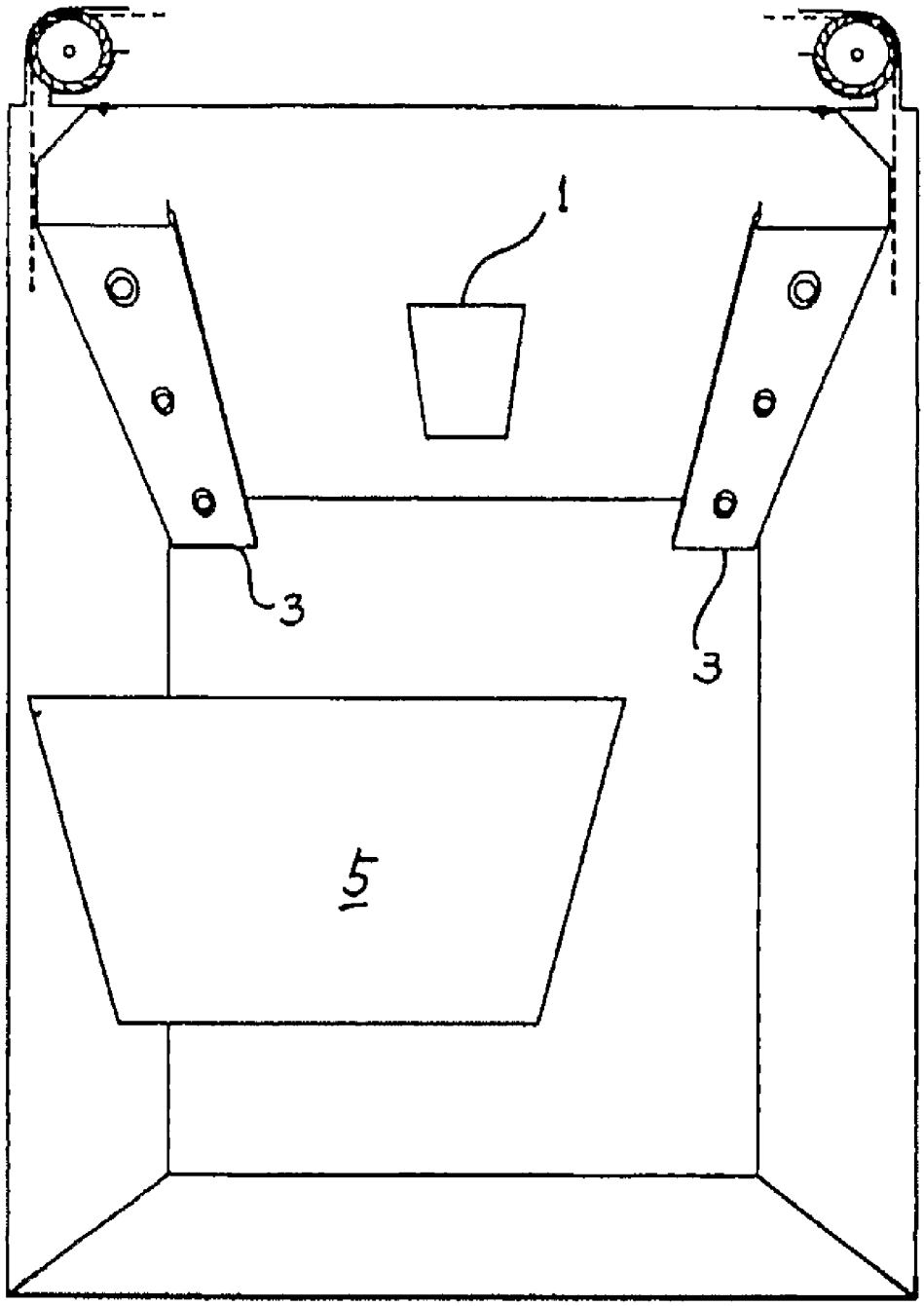

[Fig. 2]
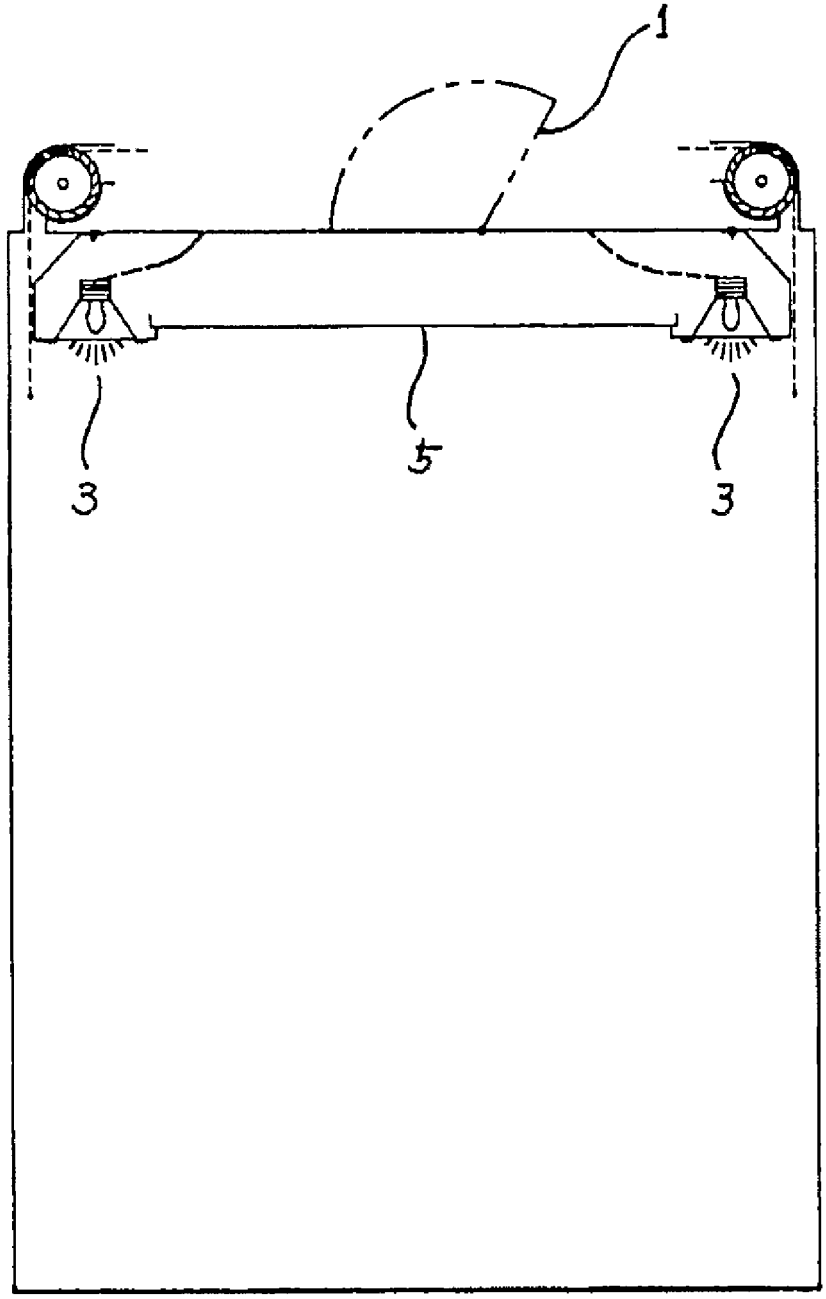

[Fig. 3]
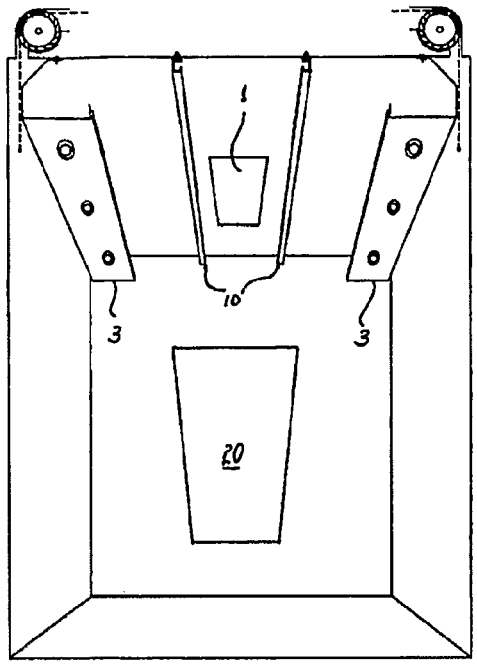
[Fig. 4]
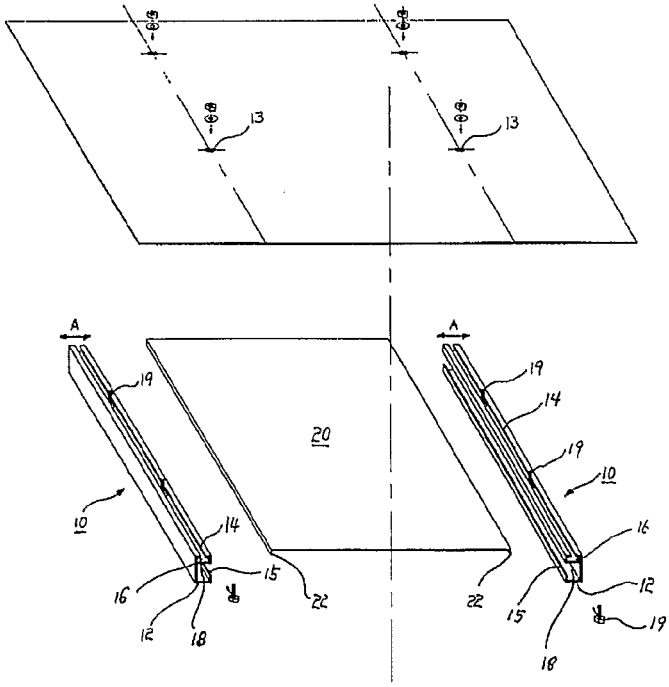

[Fig. 5]
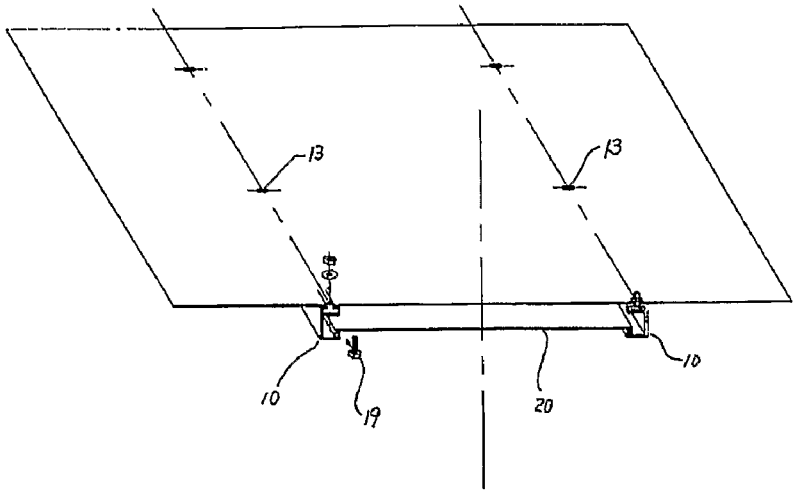
[Fig. 6]
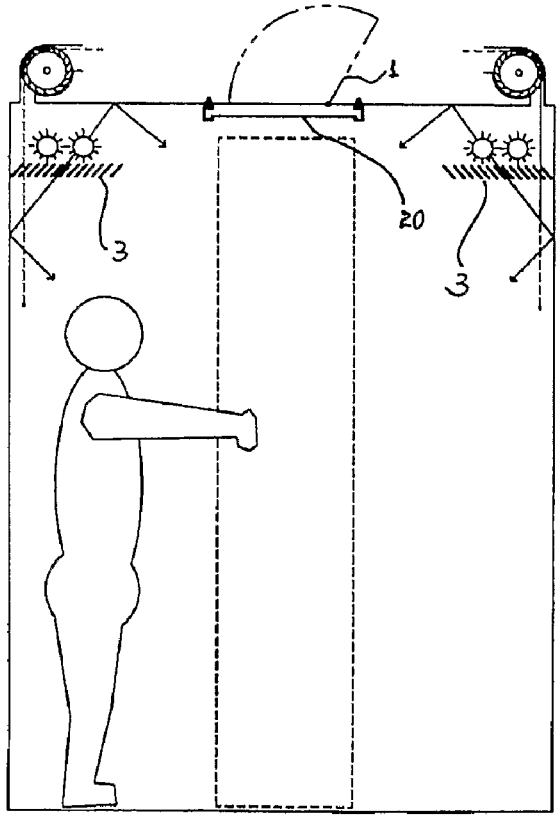

[Fig. 7]
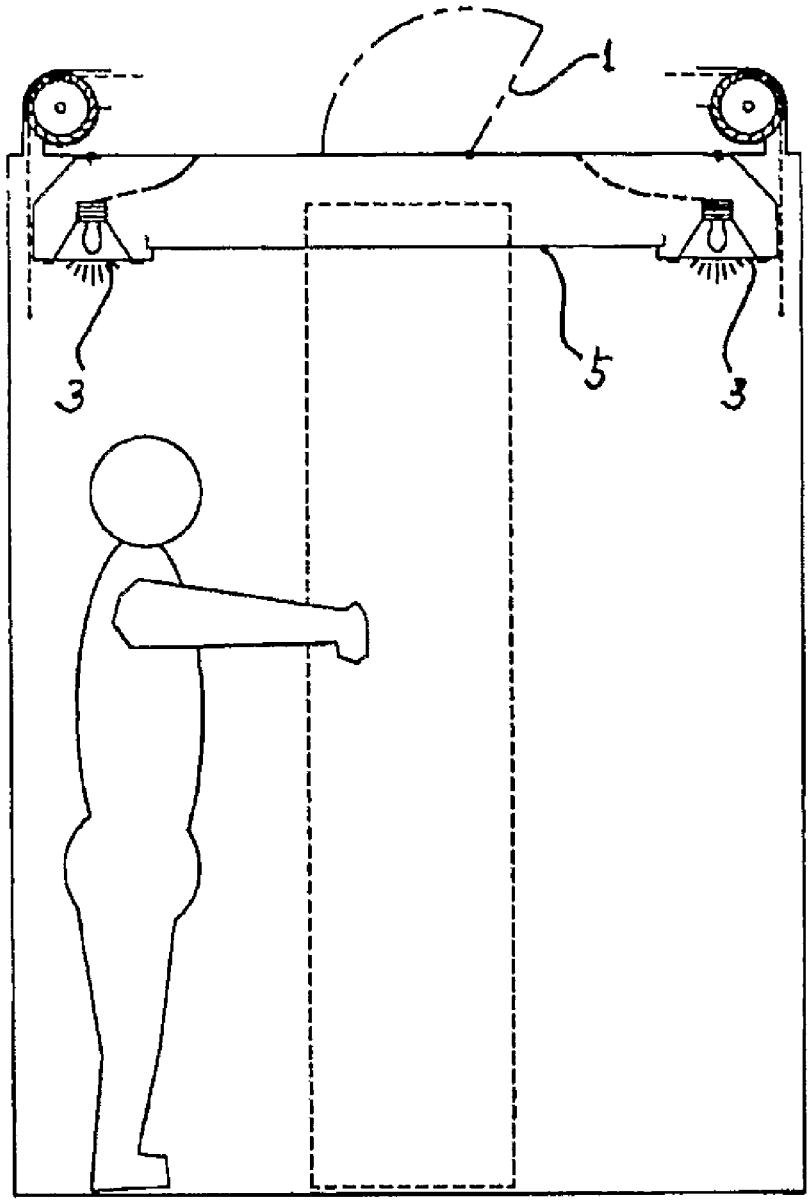

ASSISTANT CEILING DEVICE FOR SHIELDING ESCAPE HATCH OF AN ELEVATOR

TECHNICAL FIELD

The present invention relates to an assistant ceiling device for shielding an escape hatch installed to a ceiling (which will be referred to as a 'main ceiling') of an elevator cab.

BACKGROUND ART

Most elevators are provided, at a main ceiling of an elevator cab, with an escape hatch for allowing occupants to escape from the elevator in the event of emergency, in which the elevator is abnormally and abruptly stopped due to power failure or obstacles, and a door of the elevator cannot be normally opened. The escape hatch generally has a standardized size of 400×500 mm.

Conventional elevators can generally be classified into two types of elevator including an exposed type elevator in which such an emergency escape hatch is exposed to the outside, and a shielded type elevator in which the emergency escape hatch is shielded from view. For the exposed type elevator, there is a problem in that the emergency escape hatch is exposed to the view of the occupants, providing a poor appearance. Accordingly, the exposed type elevator has not been adopted for recent elevators including high-end elevators.

FIG. 1 is a perspective view illustrating the interior of a conventional shielded type elevator cab in which the escape hatch is shielded from view. Referring to FIG. 1, the elevator generally includes an emergency escape hatch 1 provided at the center of a main ceiling of an elevator cab, and ventilation fan or an illuminating means (both of which will be referred to as 'illuminating means 3') disposed at both sides of the main ceiling. These illuminating means 3 are provided in a longitudinal direction along both sides of the main ceiling of the elevator cab while being spaced a predetermined distance from each other under the main ceiling. The elevator cab is provided with a thin shielding plate 5, including a metallic plate or an acrylic plate, for covering the entire space between the illuminating spaces 3, such that both sides of the shielding plate 5 are laid between the illumination means 3. FIG. 2 is a cross sectional view of the elevator cab in which the shielding plate 5 is disposed on the illuminating means 3.

The ceiling comprising the illuminating means 3 and the shielding plate 5 is referred to an 'assistant ceiling' in the art in comparison to the main ceiling.

For such a conventional shielded-type ceiling device, which is disposed between both illuminating means, the shielding plate 5 must have a considerably large size in order to cover an overall exposed space defined between the illuminating means 3. For the elevator cab, the exposed space between the illuminating means 3 has a size of approximately 1,000×1,500 mm. The standard size of a stainless steel plate corresponding to the size of the exposed space is approximately 1,219×2,438 mm. Accordingly, only one shielding plate can be produced with the stainless steel plate having such a standard size. The remaining steel plate after producing the shielding plate is wasted or recycled. As a result, consumption of material is considerable. Additionally, several servicemen are needed in order to install such a large shielding plate 5 as an assistant ceiling below the main ceiling due to the heavy weight of the large shielding plate, and there is a large possibility of injury of the serviceman if they drop due to their weight. Needless to say, it is difficult to maintain such a large shielding plate after installing. As such, the conventional shielding plate has problems in material consumption, difficulty of transportation and excessive costs of transport due to a large volume, an excessive number of installation servicemen, difficulty in maintenance, and the like, leading to an overall increase of costs.

Additionally, since the shielding plate 5 is suspended between both illuminating means 3, the height of the ceiling in the elevator cab is considerably lowered, thereby providing a problem of difficulty in transport of tall furniture, such as bureaus, with the elevator.

In order to solve the problems, a shielding plate 5 consisting of several segments was suggested, which can be installed to the elevator cab after coupling the segments.

However, in this case, these segments of the shielding plate 5 must be accurately coupled or overlap each other in order to prevent light from being leaked out of gaps between the segments of the shielding plate 5, thereby complicating the installation of the shielding plate and requiring more man power.

DISCLOSURE OF INVENTION

Technical Problem

Therefore, the present invention has been made in view of the above problems, and it is an object of the present invention to provide an assistant ceiling device for an elevator, designed to allow easy installation of the assistant ceiling plate having a size corresponding to an emergency escape hatch, thereby reducing material consumption for the assistant ceiling device, and allowing easy installation and maintenance of the assistant ceiling device, leading to reduction of overall manufacturing costs.

It is another object of the present invention to provide the assistant ceiling device for the elevator, designed to increase the height of an inner space of an elevator cab, thereby enhancing application of the inner space of the elevator cab.

Technical Solution

In accordance with an aspect of the present invention, the above and other objects can be accomplished by the provision of an assistant ceiling device for shielding an emergency escape hatch located at the center of a ceiling of an elevator cab, the assistant ceiling device comprising: two elongated rail guides, each being installed at either side of the emergency escape hatch and having a length longer than that of the emergency escape hatch and shorter than that of the ceiling of the elevator cab; a rectangular assistant ceiling plate laid on the rail guide to shield the emergency escape hatch, wherein each of the rail guides has a latching jaw formed at a lower end of the rail guide while being bent inward, and the assistant ceiling plate is installed to the rail guides by laying both opposite sides of the assistant ceiling plate between the latching jaws.

Each of the rail guides may be formed, at an upper end, with a slot having a width through which a head of a bolt cannot pass, and with a guide recess having a passageway having a size through which the head of the bolt can freely move, so that the rail guides can be fastened to the ceiling of the elevator cab by means of the bolts equipped to the rail guides.

The ceiling of the elevator cab may be formed with a plurality of holes for inserting the bolts equipped to the rail guides, and each of the holes may be elongated perpendicular to an associated rail guide such that the rail guide is moved in a width direction of the assistant ceiling plate by a length of the holes.

Advantageous Effects

As apparent from the above description, according to the present invention, since three pieces of assistant ceiling plates can be produced by use of one conventional standard plate, material consumption is one third that of the conventional assistant ceiling plate in which only one piece of assistant ceiling plate was produced by use of one standard plate. That is, in terms of material costs, the material costs can be reduced by about ⅔. Additionally, since the assistant ceiling plate is reduced in size, thereby reducing the weight of the assistant ceiling plate, servicemen can handle the assistant ceiling plate more easily, and the number of the servicemen for installation thereof is considerably reduced. That is, for the conventional large shielding plate, three servicemen are required for the installation of the shielding plate, while for the assistant ceiling plate according to the invention, only one serviceman is required to install the assistant ceiling plate.

Thus, according to the present invention, there are advantageous effects of significantly reducing overall material costs, transportation costs, personnel expenditures, maintenance costs, and of enhanced workability due to considerably simplified installation and maintenance.

Moreover, as shown in FIG. 6 and 7, the assistant ceiling plate 20 according to the invention can be intimately installed to the main ceiling, thereby increasing a height of the inner space of the elevator cab in comparison to the conventional shielding plate.

FIG. 6 schematically shows the inner space of the elevator cab having the assistant ceiling plate according to the invention, and FIG. 6 schematically shows the inner space of the elevator cab having the conventional shielding plate. As shown in the drawings, for the elevator cab having the assistant ceiling plate Wording to the invention, the height of the inner space of the elevator cab is increased, thereby allowing furniture such as a tall bureau to be contained within the elevator cab. However, for the elevator having the conventional shielding plate, since an inner space of the elevator cab has a lower height, such tall furniture cannot be contained within the elevator cab. That is, according to the present invention, application of the inner space of the elevator cab can be remarkably enhanced.

DESCRIPTION OF DRAWINGS

The above and other objects, features and other advantages of the present invention will be more clearly understood from the following detailed description taken in conjunction with the accompanying drawings, in which:

FIG. 1 is a perspective view illustrating the interior of a conventional assistant ceiling plate of an elevator cab;

FIG. 2 is a cross-sectional view illustrating the assistant ceiling plate of FIG. 1 in an assembled state;

FIG. 3 is a perspective view illustrating the interior of an assistant ceiling device according to the present invention in a disassembled state;

FIG. 4 is a perspective view illustrating the construction of an assistant ceiling plate according to the present invention;

FIG. 5 is a perspective view illustrating the assistant ceiling plate according to the present invention in an assembled state;

FIG. 6 is a sectional side view illustrating an application of an inner space of an elevator having the assistant ceiling device according to the present invention; and FIG. 7 is a sectional side view illustrating the inner space of the elevator cab having the conventional assistant ceiling device.

BEST MODE

Preferred embodiments will now be described in detail with reference to the accompanying drawings.

FIG. 3 is a schematic perspective view illustrating the interior of an assistant ceiling device according to the present invention.

Referring to FIG. 3, an elevator includes an emergency escape hatch 1 provided at the center of a main ceiling of an elevator cab. Like the conventional elevator, illuminating means 3 are disposed at both sides of the main ceiling, and the construction of the illuminating means 3 will be described below. Two elongated rail guides 10 are installed at both sides of the emergency escape hatch 1, respectively. In FIG. 3, although the rail guides 10 are extended along an entire length of the main ceiling, the length of the rail guides 10 can be varied, if necessary, under the conditions that the rail guide 10 has a length longer than that of the emergency escape hatch and the same as or less than that of the ceiling of the elevator cab.

A rectangular assistant ceiling plate 20 is laid between two rail guides 10 to shield the emergency escape hatch 1. The assistant ceiling plate 20 may comprise all kinds of plate material, including a thin metallic plate, an acrylic plate, a wooden plate, and the like, which can shield the emergency escape hatch from view, inside the elevator. In order to lay the assistant ceiling plate 20 on both rail guides 10, each of the rail guides 10 has a latching jaw 12 formed at a lower end of the rail guide 10 while being bent inward, such that the assistant ceiling plate 20 is installed between the rail guides 10 by laying both opposite sides of the assistant ceiling plate 20 on the latching jaws 12 of the rail guides 10 (see FIGS. 4 & 5).

As described above, a standard plate has a size of 1,219×2,438 mm, and the emergency escape hatch 1 has a size of 400×500 mm. Accordingly, three pieces of assistant ceiling plates 20 for shielding the emergency escape hatch 1 can be cut with one standard plate. That is, according to the present invention, material consumption is one third that of the conventional assistant ceiling plate.

FIGS. 4 and 5 are perspective views illustrating the relationship between the rail guides 10 and the assistant ceiling plate 20 in detail. FIG. 4 shows a disassembled state of the assistant ceiling plate 20, while FIG. 5 shows an assembled state thereof.

As shown in the drawings, each of the rail guides 10 is formed, at an upper end, with a slot 14 having a width through which a head of a fastener cannot pass, and with a guide recess 18 with a passageway 16 having a size through which the head of the fastener can freely move. The rail guides 10 can be coupled to the main ceiling of the elevator cab, by coupling fasteners 19 to the main ceiling, with a predetermined number of fasteners 19, such as bolts, fastened into the guide recess 18.

Meanwhile, the main ceiling of the elevator cab is formed with a plurality of holes 13 for inserting the fasteners, that is, the bolts, equipped to the guide recesses 18 of the rail guides 10. Although each of the holes may have any shape, it is preferably an elongated hole, which is elongated substantially perpendicular to an associated rail guide 10. With such elongated holes perpendicular to the associated guides 10, the rail guides 10 can be moved in the direction indicated by arrow A under the condition in which the rail guides 10 are adapted to have a length of the elongated holes. Accordingly, even if the assistant ceiling plate 20 is not accurately cut, a tolerance can be accepted in the assistant ceiling plate 20 to the extent that corresponds to the length of the holes 13, thereby allowing easy installation of the assistant ceiling plate 20. Additionally, since the fasteners 19 can freely move within the passageways 16, the rail guides 10 can also be moved in the longitudinal direction as desired. That is, the rail guides 10 can be linearly moved a predetermined distance, thereby allowing easy installation and positional adjustment of the assistant ceiling plate 20.

Moreover, in order to prevent unwanted detachment or separation of the assistant ceiling plate 20, the assistant ceiling plate 20 may have downward protrusions 22 formed at both ends of the assistant ceiling plate 20, and upper protrusions 15 formed at inner ends of the latching jaws 12, respectively. In this case, the downward protrusions 22 formed at both ends of the assistant ceiling plate 20 are engaged with the upper protrusions 15 formed at inner ends of the latching jaws 12, thereby securely preventing the possibility of abrupt or unwanted separation of the assistant ceiling plate 20. Meanwhile, since the assistant ceiling plate 20 is not fastened to both guides 20, it can be easily and conveniently separated from the guides 20, if necessary, for example, when cleaning the interior of the elevator or in the event of emergency, when occupants must escape from the elevator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An assistant ceiling device for shielding an emergency escape hatch located at a ceiling of an elevator cab, wherein said elevator cab includes one or more rows of hanging illuminating means along a length of said elevator cab, the assistant ceiling device comprising:

(a) two elongated rail guides attached to said ceiling of said elevator cab, wherein said two rail guides are positioned on opposing sides of said emergency escape hatch, wherein said two rail guides are approximately parallel to each other, wherein each of said rail guides has a slot and a guide recess along a longitudinal extent of said rail guides, wherein said slot and said guide of each of said rail guides are situated on an upper end of said rail guides, wherein the upper end of each of said rail guides is adjacent to said ceiling of said elevator cab, wherein each of said rail guides has a latching jaw situated on a lower end of said rail guides, and wherein said latching jaw of each of said rail guides comprises upper protrusions, (b) one or more fasteners for attaching each of said rail guides to said ceiling of said elevator cab, wherein each of said fasteners has a head positioned in said guide recess of one of said rail guides, wherein said head of each of said fasteners can freely move in said guide recess of said rail guides, and wherein said head of each of said fasteners cannot pass through said slot of said rail guides, and (c) an assistant ceiling plate, wherein said assistant ceiling plate comprises a rectangular plate, wherein said assistant ceiling plate comprises one or more downward protrusions on opposing sides of said assistant ceiling plate, wherein said assistant ceiling plate is positioned on said latching jaws of both of said rail guides, and wherein said downward protrusions of said assistant ceiling plate are engaged with said upper protrusions of said latching jaws of said rail guides, wherein said assistant ceiling plate visually shields said escape hatch, wherein said assistant ceiling plate can be separated from said rail guides and is moveable along said rail guides, and wherein said assistant ceiling plate does not cover said hanging illuminating means of said elevator cab.

2. The device as set forth in claim 1, wherein said one or more fasteners comprises one or more bolts, wherein the ceiling of the elevator cab has a plurality of holes for inserting the bolts, wherein each of the holes is elongated in a direction perpendicular to the longitudinal extent of said rail guides, and wherein said rail guides are moveable in an elongated direction of said holes.

3. The device as set forth in claim 1, wherein said assistant ceiling plate is positioned above said hanging illuminating means of said elevator cab.

* * * * *